US009382813B2

(12) United States Patent
Reid et al.

(10) Patent No.: US 9,382,813 B2
(45) Date of Patent: Jul. 5, 2016

(54) TURBOMACHINE DIAPHRAGM RING WITH PACKING RETAINMENT APPARATUS

(71) Applicant: General Electric Company, Schenectady, NY (US)

(72) Inventors: Thomas Robert Reid, Schenectady, NY (US); James Peter Anderson, Clifton Park, NY (US); Steven Sebastian Burdgick, Schenectady, NY (US); Mark Richard DeLorenzo, Schnectady, NY (US)

(73) Assignee: General Electric Company, Schenectady, NY (US)

( * ) Notice: Subject to any disclaimer, the term of this patent is extended or adjusted under 35 U.S.C. 154(b) by 854 days.

(21) Appl. No.: 13/693,644

(22) Filed: Dec. 4, 2012

(65) Prior Publication Data

US 2014/0154070 A1 Jun. 5, 2014

(51) Int. Cl.

| | |
|---|---|
| ***F01D 25/24*** | (2006.01) |
| ***F01D 9/04*** | (2006.01) |
| ***F01D 11/00*** | (2006.01) |

(52) U.S. Cl.

CPC ..... *F01D 25/246* (2013.01); *F01D 9/04* (2013.01); *F01D 11/003* (2013.01); *F01D 25/24* (2013.01); *F05D 2220/31* (2013.01)

(58) Field of Classification Search

CPC ..... F01D 9/04; F01D 25/24; F01D 24/246; F01D 11/001; F01D 11/003; F01D 11/02; F05D 2260/30; F16J 15/447; F16J 15/4472; F16J 15/4474

USPC ..... 415/209.2, 230, 174.5, 213.1; 277/412, 277/413, 419, 421

See application file for complete search history.

(56) References Cited

U.S. PATENT DOCUMENTS

| | | | | |
|---|---|---|---|---|
| 5,709,388 | A * | 1/1998 | Skinner | F01D 11/025 277/412 |
| 6,648,332 | B1 | 11/2003 | Burdgick | |
| 6,651,986 | B2 * | 11/2003 | Chevrette | F16J 15/442 277/416 |
| 6,695,316 | B2 * | 2/2004 | Popa | F16J 15/442 277/411 |
| 7,097,423 | B2 | 8/2006 | Burdgick | |
| 7,484,927 | B2 * | 2/2009 | Chevrette | F01D 11/003 415/113 |
| 2011/0305566 | A1 | 12/2011 | Sankolli et al. | |

FOREIGN PATENT DOCUMENTS

| | | | | |
|---|---|---|---|---|
| CN | 101054909 | B | 1/2011 | |
| GB | 135949 | A * | 12/1919 | F01D 11/02 |
| JP | 05125902 | A * | 5/1993 | |

* cited by examiner

*Primary Examiner* — Ninh H Nguyen
*Assistant Examiner* — Jesse Prager
(74) *Attorney, Agent, or Firm* — Ernest G. Cusick; Hoffman Warnick LLC

(57) ABSTRACT

Various embodiments include a turbomachine diaphragm ring. In various particular embodiments, a turbomachine diaphragm ring includes: a packing slot sized to house a dovetail section of a turbomachine packing, the packing slot extending circumferentially about a rotational axis of the turbomachine; a key slot connected with the packing slot sized to house a portion of a key member, the key slot extending at least one of radially or axially from the packing slot; and a retaining slot connected with the key slot and extending substantially circumferentially from the key slot, the retaining slot sized to house a retaining member for retaining the key member.

11 Claims, 7 Drawing Sheets

TURBOMACHINE DIAPHRAGM RING WITH PACKING RETAINMENT APPARATUS

FIELD OF THE INVENTION

The subject matter disclosed herein relates to power systems. More particularly, the subject matter relates to turbomachine systems.

BACKGROUND OF THE INVENTION

Conventional turbomachines (also referred to as turbines), such as steam turbines (or, steam turbomachines), generally include static nozzle assemblies that direct the flow of working fluid (e.g., steam) into rotating buckets that are connected to a rotor. In steam turbines the nozzle (or, airfoil) construction is typically called a "diaphragm" or "nozzle assembly" stage. Nozzle assemblies are assembled in two halves around the rotor, creating a horizontal joint. At the horizontal joint are packings which prevent steam leakage across the rotor. Traditional packings use a key at the horizontal joint to prevent the packings in the upper half from dropping out during assembly/disassembly, and to inhibit rotation of the packings in their slots (or, dovetail slots) should the rotor contact the packings during operation. Gravitational forces keep the packing segments in the lower half in place.

In variable clearance positive pressure packings (VCPPP), two separate key designs are used for the upper and lower half. These packings use pressure to activate the location of the seals during operation, from an open radial position to a closed radial position. Because these packings move radially as a function of steam load, a key is used for the lower half packings to keep the left and right packing segments from dropping into the middle packing segment and preventing the packing segments from closing properly. A key for the VCPPP design serves two purposes: (1) to retain the packing segments; and (2) to allow for motion of the packing in the radial direction.

However, conventional key configurations for retaining packing segments (e.g., VCPPP packing segments) in the lower half of a turbine require significant real estate, add high sensitivity to calculations due to the friction between the key and ring, and have mechanical disadvantages associated with bending stresses, local wear, and distortion of parts. For more contemporary steam path designs, the spacing between the bucket and nozzles is shrinking, and the radial inner ring height is also getting smaller. These factors make it difficult to retain turbine packings in a manner that occupies little real estate while maintaining limited friction and proper location of the packing.

BRIEF DESCRIPTION OF THE INVENTION

Various embodiments include a turbomachine diaphragm ring including a packing retaining apparatus. In various particular embodiments, a turbomachine diaphragm ring includes: a packing slot sized to house a dovetail section of a turbomachine packing, the packing slot extending circumferentially about a rotational axis of the turbomachine; a key slot connected with the packing slot sized to house a portion of a key member, the key slot extending at least one of radially or axially from the packing slot; and a retaining slot connected with the key slot and extending substantially circumferentially from the key slot, the retaining slot sized to house a retaining member for retaining the key member.

A first aspect of the invention includes a turbomachine diaphragm ring having: a packing slot sized to house a dovetail section of a turbomachine packing, the packing slot extending circumferentially about a rotational axis of the turbomachine; a key slot connected with the packing slot sized to house a portion of a key member, the key slot extending at least one of radially or axially from the packing slot; and a retaining slot connected with the key slot and extending substantially circumferentially from the key slot, the retaining slot sized to house a retaining member for retaining the key member.

A second aspect of the invention includes a turbomachine diaphragm including: a packing having a dovetail section including a first key slot; and a diaphragm ring coupled with the packing, the diaphragm ring including: a packing slot sized to house the dovetail section of the packing; a second key slot connected with the packing slot and sized to house a portion of a key member, the second key slot extending at least one of radially or axially from the packing slot; and a retaining slot connected with the second key slot and extending substantially circumferentially from the second key slot, the retaining slot sized to house a retaining member for retaining the key member.

A third aspect of the invention includes a turbomachine packing including: a main body; a seal section extending axially inward from the main body and including a plurality of seal teeth; and a dovetail section extending axially outward from the main body, the dovetail section including: a pair of axially extending flanges; and a key slot within at least one of the pair of axially extending flanges, the key slot sized to receive a key member, wherein the main body, the seal section and the dovetail section have a common horizontal joint surface, and wherein the key slot is offset from the horizontal joint surface.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
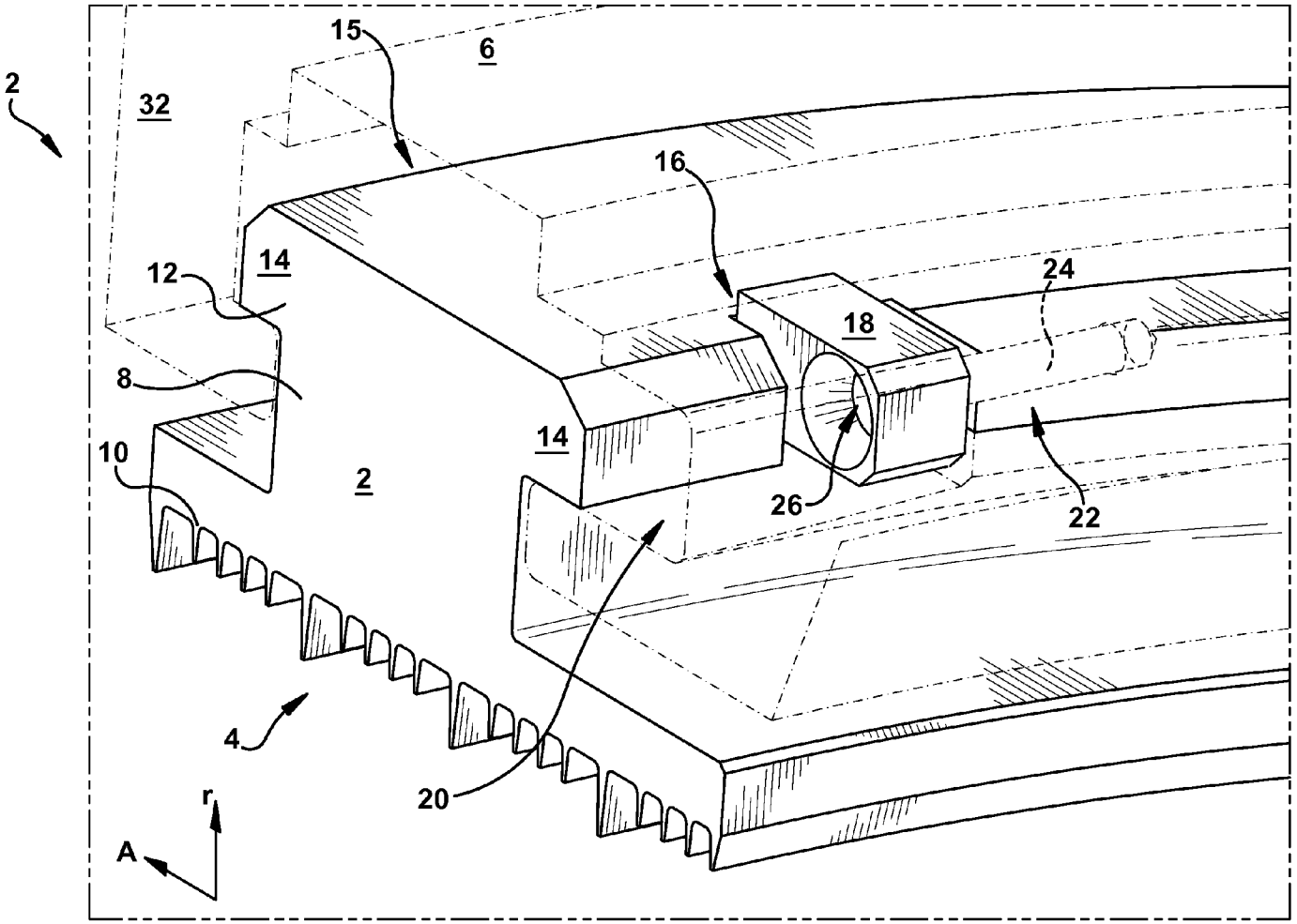
FIG. 1 shows a schematic three-dimensional perspective view of a portion of a turbomachine diaphragm according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to power systems. More particularly, the subject matter relates to turbomachine systems.

As described herein, conventional key configurations for retaining packing segments (e.g., VCPPP packing segments) in the lower half of a turbine require significant real estate, add high sensitivity to calculations due to the friction between the key and ring, and have mechanical disadvantages associated with bending stresses, local wear, and distortion of parts. One conventional configuration uses a packing bolt which secures the packing by penetrating the packing to hold it in place. For more contemporary steam path designs, the spacing between the bucket and nozzles is shrinking, and the radial inner ring height (space between the rotor and nozzle inner flow path) is also getting smaller. These factors make it difficult to retain turbine packings in a manner that occupies little real estate while maintaining limited friction and proper location of the packing.

In contrast to the conventional approaches, aspects of the invention include a retainment configuration for a turbomachine which effectively retains a diaphragm packing and diaphragm ring. The packing retainment configuration overcomes issues with the prior art, and allows for at least one of a radial or axial key option, e.g., radial, axial or at least partially radial and at least partially axial key options. In either the radial or axial key option, the diaphragm ring includes a slot (key slot) which occupies significantly less space than the conventional retainment devices, as the key is at least partially housed in the diaphragm ring. This arrangement also allows for a smaller and more simplified key than in conventional designs.

In various embodiments, the key member includes a titanium coated key, and offers mechanical advantages such as reduced bending stresses, less grinding and distortion of parts. In addition, the proposed key allows for radial movement of the packing segments (e.g., in the VCPPP design) through a machined groove (key slot) in the packing dovetail.

Various particular embodiments of the invention include a turbomachine diaphragm ring having: a packing slot sized to house a dovetail section of a turbomachine packing, the packing slot extending circumferentially about a rotational axis of the turbomachine; a key slot connected with the packing slot sized to house a portion of a key member, the key slot extending at least one of radially or axially from the packing slot; and a retaining slot connected with the key slot and extending substantially circumferentially from the key slot, the retaining slot sized to house a retaining member for retaining the key member.

Various other particular aspects of the invention include a turbomachine diaphragm including: a packing having a dovetail section including a first key slot; and a diaphragm ring coupled with the packing, the diaphragm ring including: a packing slot sized to house the dovetail section of the packing; a second key slot connected with the packing slot and sized to house a portion of a key member, the second key slot extending at least one of radially or axially from the packing slot; and a retaining slot connected with the second key slot and extending substantially circumferentially from the second key slot, the retaining slot sized to house a retaining member for retaining the key member.

Various other particular aspects of the invention include a turbomachine packing including: a main body; a seal section extending axially inward from the main body and including a plurality of seal teeth; and a dovetail section extending axially outward from the main body, the dovetail section including: a pair of axially extending flanges; and a key slot within at least one of the pair of axially extending flanges, the key slot sized to receive a key member, wherein the main body, the seal section and the dovetail section have a common horizontal joint surface, and wherein the key slot is offset from the horizontal joint surface.

As used herein, the terms "axial" and/or "axially" refer to the relative position/direction of objects along an axis (A), which is substantially perpendicular to the axis of rotation of the turbomachine (in particular, the rotor section). As further used herein, the terms "radial" and/or "radially" refer to the relative position/direction of objects along an axis (r), which is substantially perpendicular with axis A and intersects axis A at only one location. Additionally, the terms "circumferential" and/or "circumferentially" refer to the relative position/direction of objects along a circumference (C) which surrounds axis (A) but does not intersect the axis (A) at any location.

Turning to FIG. 1, a schematic three-dimensional perspective view of a portion of a turbomachine diaphragm (or simply, diaphragm) 2 is shown according to various embodiments of the invention. As shown, the turbomachine diaphragm 2 can belong to a larger turbomachine, e.g., a steam turbine. In various embodiments, the diaphragm 2 can include a packing 4. The diaphragm 2 can also include a diaphragm ring 6 (shown as partially transparent for the purposes of illustrating various aspects of the invention) coupled with the packing 4. The packing 4 can include a main body section 8, a seal section 10 which extends radially inward from the main body section 8. The seal section 10 can act as an axial seal to direct fluid flow within the turbomachine. The packing 4 can further include a dovetail section 12, which extends radially outward from the main body section 8. The dovetail section 12 can include a pair of axially extending flanges 14, which are designed to engage with a circumferentially disposed packing slot 15 in the diaphragm ring 6. As described further herein, the dovetail section 12 (in particular, at least one of the axially extending flanges 14) can include a first key slot 16 for housing (and in some cases, retaining) a portion of a key member 18 (also further described herein).

As noted, the diaphragm ring 6 includes the packing slot 15 which is sized to engage the dovetail section 12 including the pair of axially extending flanges 14. The diaphragm ring 6 also includes a second key slot 20, which is connected with the packing slot 15 (e.g., fluidly connected such that air or another fluid could flow freely from one to the other). The second key slot 20 is sized to house another portion of the key member 18 (distinct from the portion housed in the first key slot 16 of the dovetail section 12 of the packing 4). In some embodiments, as shown in FIG. 1, the second key slot 20 extends axially from the packing slot 15. However, in other embodiments, such as that depicted in the schematic end view of FIG. 2, the second key slot 20 extends radially from the packing slot 15.

Also shown, the diaphragm ring 6 can include a retaining slot 22 which is connected with the second key slot 20 (e.g., fluidly connected, as described herein). The retaining slot 22 extends substantially circumferentially from the second key slot 20, e.g., substantially parallel with the packing slot 15. As will be described further herein, the retaining slot 22 can be sized to house a retaining member (e.g., a screw, bolt, pin, etc.) 24 (shown in phantom in FIG. 1) for retaining the key member 18 within the second key slot 20. In some cases, e.g., where the retaining member 24 includes an at least partially threaded exterior, the retaining slot 22 can include internal threads to complement the threads of the retaining member 24.

The key member 18 can be formed of a metal such as steel, aluminum, or any suitable alloys thereof. The key member 18 can include a coating having a friction-reducing material over the metal, which allows for movement of the key member 18 within the first key slot 16 and/or second key slot 20 when desirable. This friction-reducing coating can include titanium nitride (TiN) in some cases. As described herein, in some embodiments, the key member 18 is positioned within the first key slot 16 and the second key slot 20 such that it restricts movement of the packing 4 relative to the diaphragm ring 6. The key member 18 can include an aperture 26 for receiving the retaining member 24 and aligning with the retaining slot 22. In some cases, the aperture 26 includes a tapered section 28 which allows for easier access to the key member 18 (e.g., by a tool such as a screwdriver, wrench, etc.). When the key member 24 is engaged with the retaining slot 22, it couples the key member 18 to the diaphragm ring 4. That is, the retaining member 24 restricts movement of the key member 24 in the first key slot 16 and the second key slot 20, and when the retaining member 24 is engaged with the retaining slot 22, the key member 24 then restricts movement of the packing 4 relative to the diaphragm ring 6. As noted herein, the key member 18 can include a screw in some embodiments, and in particular cases, a flat-head cap screw.

It is understood that in various alternative embodiments, as further shown and described herein, the key member 18 can take the form of a dowel or dowel rod which extends between the first key slot 16 and the second key slot 20, and is staked into the diaphragm ring 6, e.g., in the retaining slot 22. In other cases, the key member 18 can include a key as shown (or a dowel) which extends between the first key slot 16 and the second key slot 20, and is attached to the packing 4 (in the first key slot 16) via a screw or weld.

Figure 2:
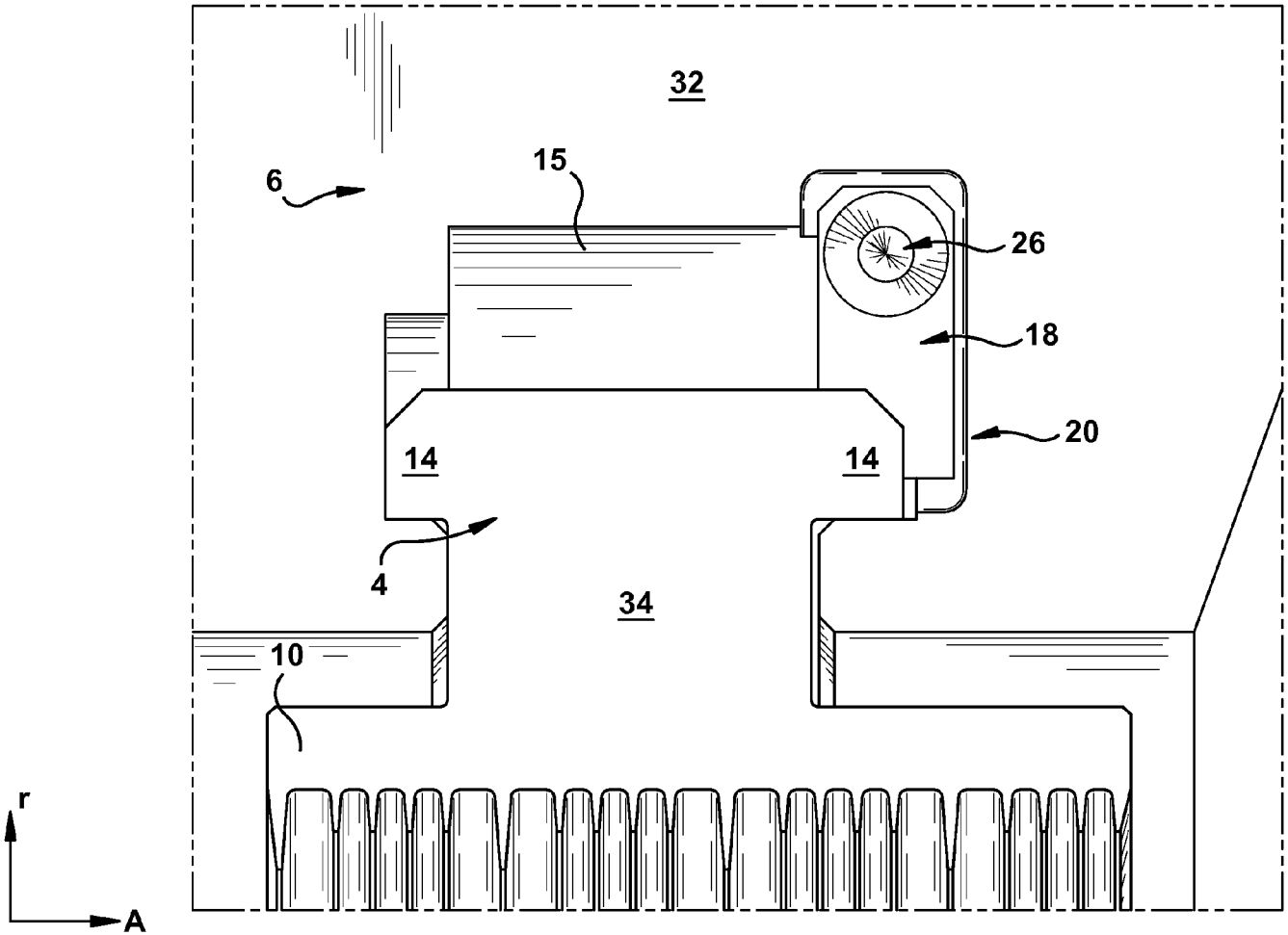
FIG. 2 shows an end view of a portion of a turbomachine diaphragm according to various alternate embodiments of the invention.

FIGS. 1 and 2 illustrate that the diaphragm ring 6 includes a horizontal joint surface 32, which is designed to align with a horizontal joint surface 34 of the packing 4. As is known in the art, these horizontal joint surfaces 32, 34 are intended to coincide at the horizontal joint of the turbomachine to which they belong, forming a junction between an upper half of the diaphragm and a lower half of the diaphragm. Shown herein is a section of a half of the turbomachine diaphragm 2, illustrating a horizontal joint surface 32 of the diaphragm ring 6, and a horizontal joint surface of the packing 4. As is known in the art, the main body 8, the seal section 10 and the dovetail section 12 of the packing 4 share a common horizontal joint surface 34.

As shown in FIG. 1 (with axially extending key member 18 and second key slot 20) and FIG. 2 (with radially extending key member 18 and second key slot 20), the second key slot 20 opens at the horizontal joint surface 32 to allow access to the second key slot 20 from the horizontal joint surface 32 (or a location above the horizontal joint surface 32). This allow for, among other things, access to the key member 18 (and retaining member 24) from the horizontal joint surface. In some cases, an operator can access the key member 18 (and retaining member 24) via the second key slot 20, in particular, its opening at the horizontal joint surface 32 of the diaphragm ring 6.

In various embodiments, the retaining slot 22 extends substantially circumferentially away from the horizontal joint surface 32 of the diaphragm ring 6, as well as from the second key slot 20. That is, the retaining slot 22 is aligned with the second key slot 20, and extends away from the horizontal joint surface 32 in such a manner that the retaining member 24 can be removed/inserted vertically from the retaining slot 26 and the second key slot 20. In some cases, the retaining slot 26 also extends at least partially radially (e.g., radially outward) from the second key slot 20. This slightly angled retaining slot 26, which causes the retaining member 24 to be slightly angled from normal with respect to the key member 28, can help to stabilize the key member 18 in the second key slot 20.

Figure 3:
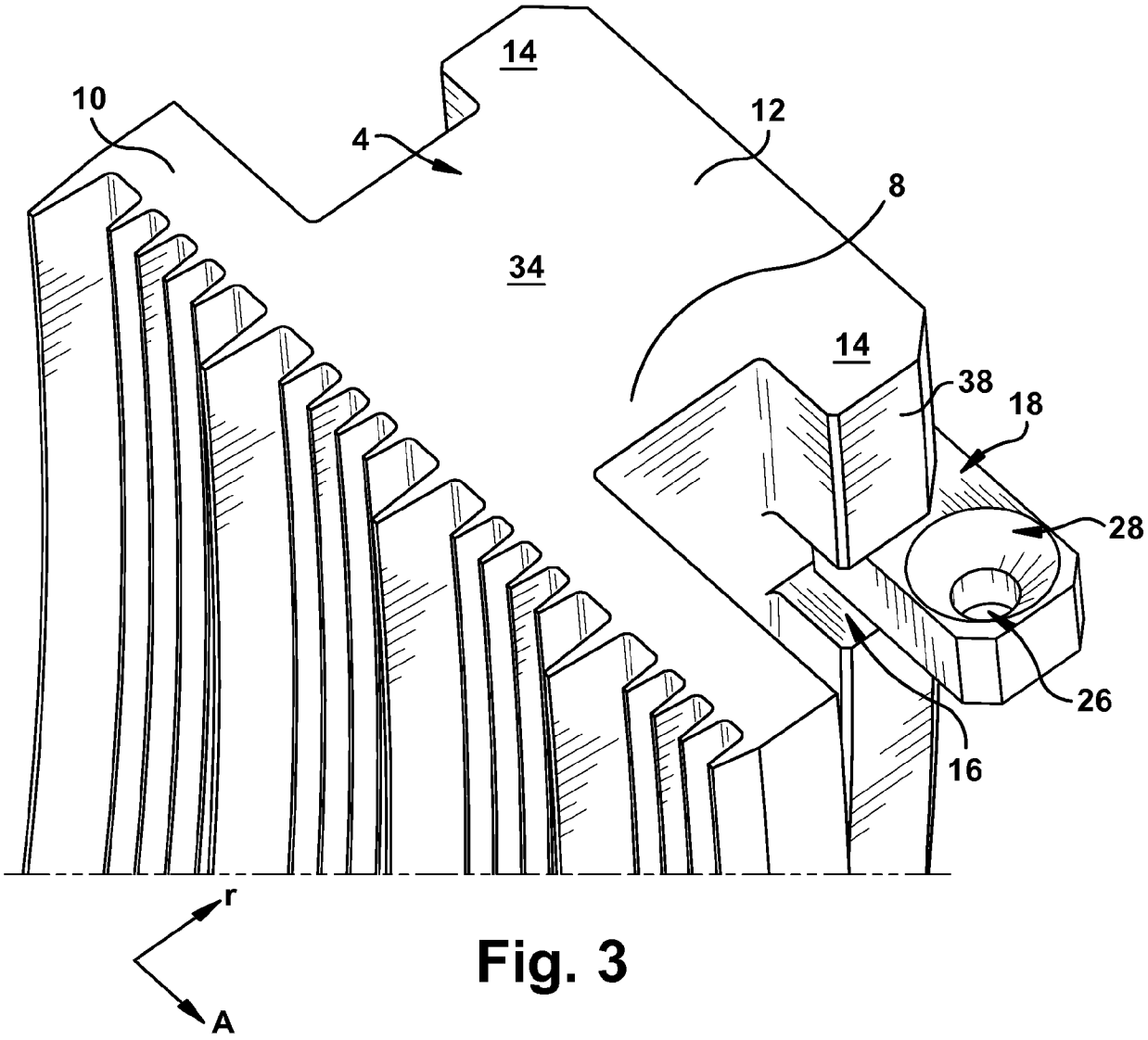
FIG. 3 shows a schematic three-dimensional perspective view of a turbomachine packing and a key, according to various embodiments of the invention.

FIG. 3 shows a schematic three-dimensional perspective view of the turbomachine packing 4, along with the key member 18, according to various embodiments of the invention. In this embodiment, the key member 18 is shown axially aligned with the first key slot 16, however, it is understood that the key member 18 could be rotated to align radially with the first key slot 16. In some cases, the same packing 4, including the first key slot 16, could be used with either embodiment of the diaphragm ring 6 (either axially aligned or radially aligned second key slot 20).

As is illustrated in FIG. 3, the first key slot 16 is positioned within at least one of the pair of axially extending flanges 14 of the dovetail section 12. In some cases, the first key slot 16 extends entirely radially through the flange 14 of the dovetail section 12, allowing access to the first key slot 16 from a radially inner opening and a radially outer opening of the first key slot 16, even when within the diaphragm ring 6 (FIGS. 1 and 2). The first key slot 16 is offset from the horizontal joint surface 34, such that a portion 38 of the packing 4 lies between the first key slot 16 and the horizontal joint surface 32.

Figure 4:
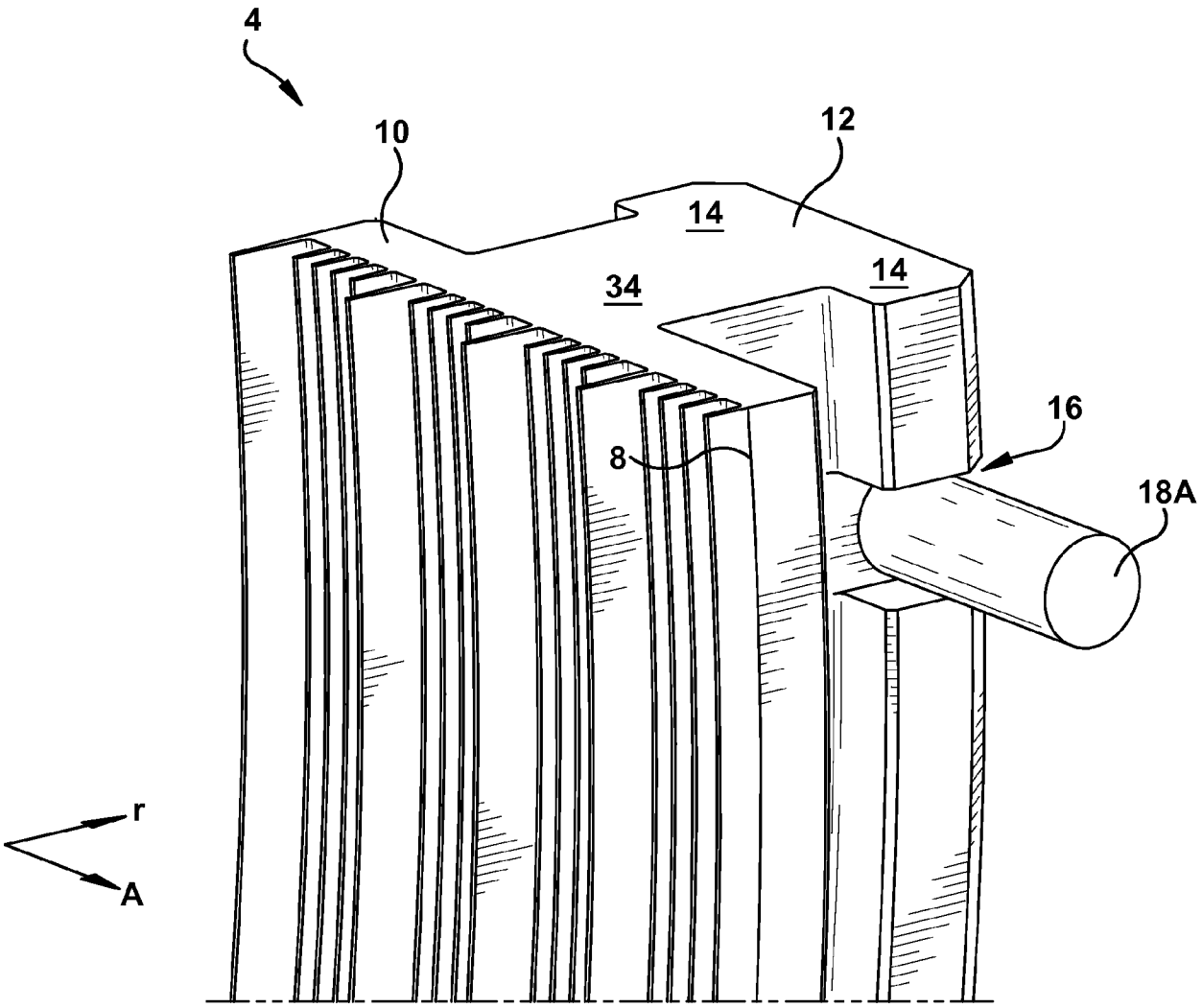
FIG. 4 shows a schematic three-dimensional perspective view of a turbomachine packing and a key, according to various alternate embodiments of the invention.
Figure 5:
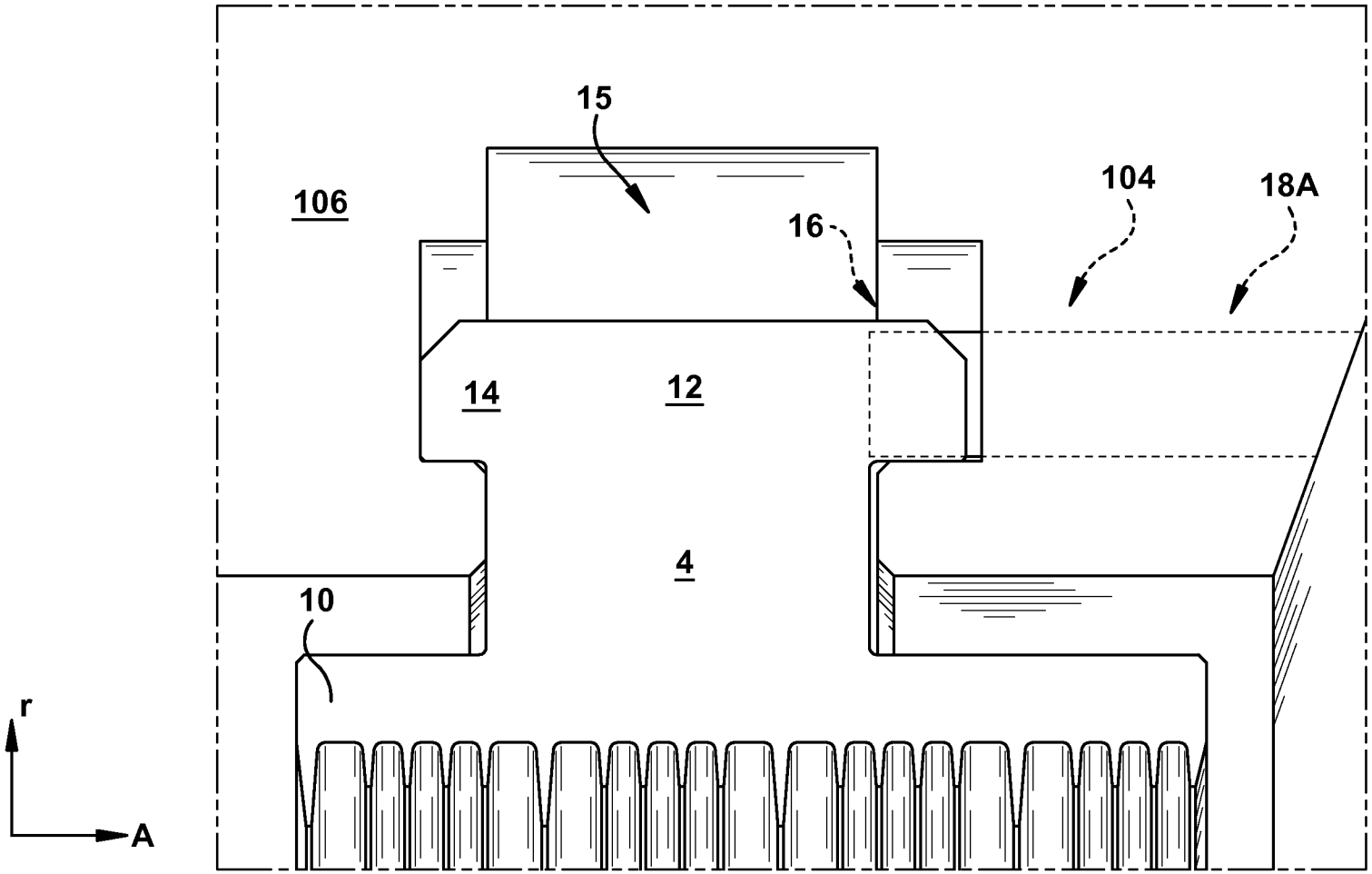
FIG. 5 shows an end view of a portion of a turbomachine diaphragm according to various alternate embodiments of the invention.

FIGS. 4-5 show an alternate embodiment depicting a key member 18 which includes a dowel 18A. The dowel 18A is configured to interact with the first key slot 16, which can extend radially through the flange 14 of the dovetail section 12. In some cases, as shown in FIG. 5, the dowel 18A can interface with a slot 104 of a diaphragm ring 106. The slot 104 can extend axially within the diaphragm ring 106, as shown in FIG. 5. However, in alternate embodiments, the slot 104 can extend at least partially radially, at least partially axially, or a combination of axially and radially through an internal portion of the diaphragm ring 106. The dowel 18A can be staked through the slot 104 in the diaphragm ring 106, and welded and/or brazed into place on the ring 106, thereby fixing its position relative to the diaphragm ring 106. The diaphragm ring 106 shown and described with reference to FIG. 5 can differ from the diaphragm ring 6 of FIGS. 1-2, in that diaphragm ring 106 can allow for fixing of the position of the dowel 18A via welding and/or brazing in slot 104, without a retaining slot 22. That is, in this case, the diaphragm ring 106 can retain the dowel 18A, and therefore, a circumferential position of the packing 2, using only the dowel 18A fixed within the slot 104.

Figure 6:
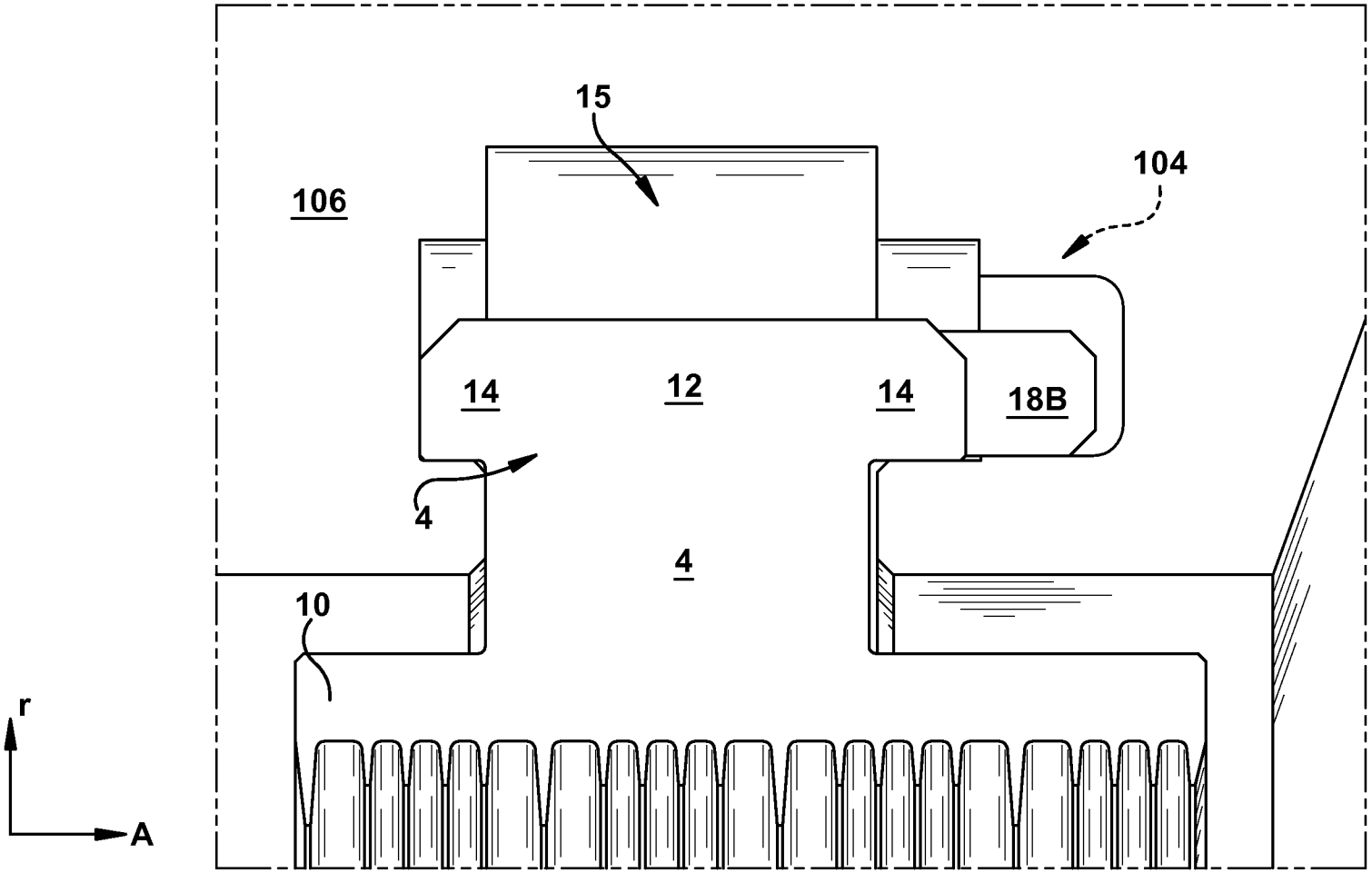
FIG. 6 shows an end view of a portion of a turbomachine diaphragm according to various alternate embodiments of the invention.
Figure 7:
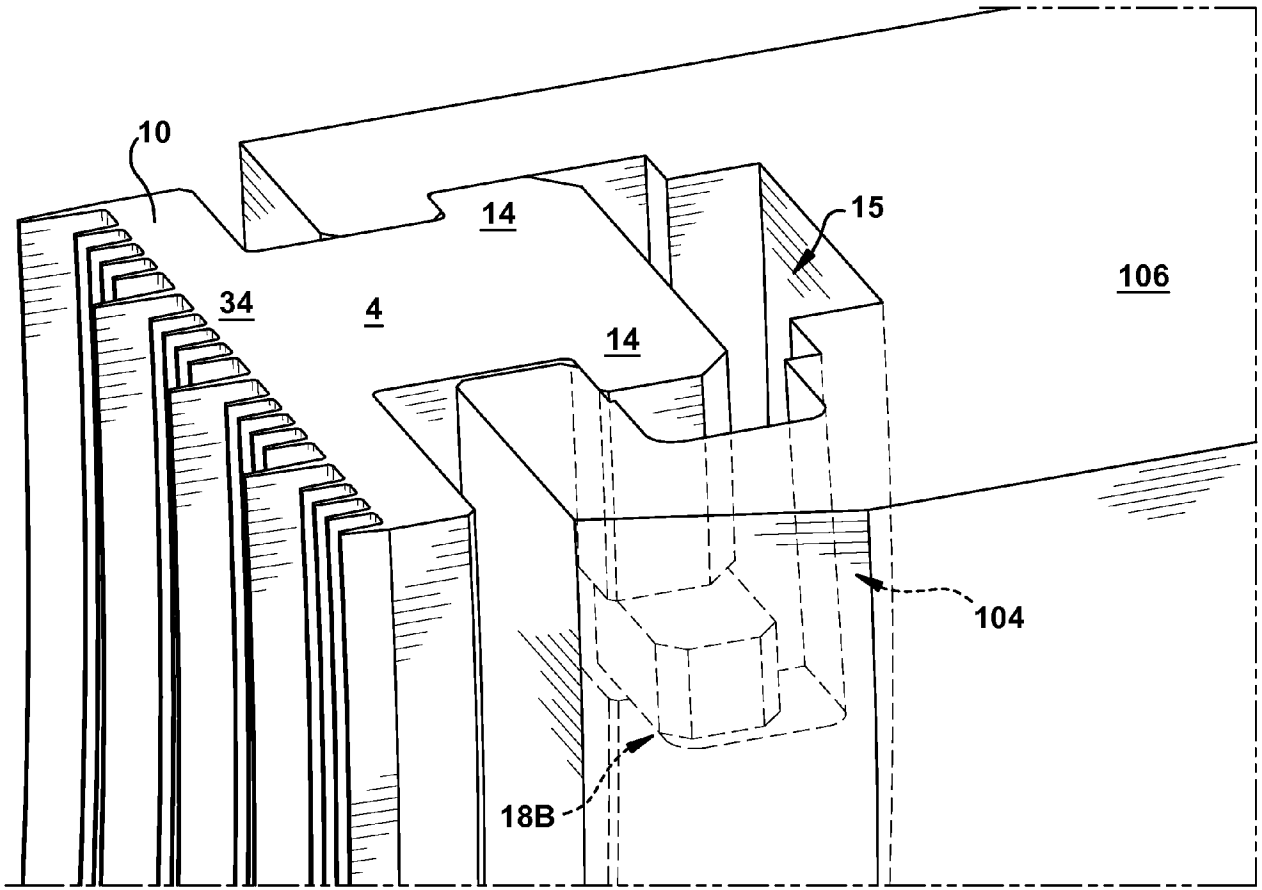
FIG. 7 shows a schematic three-dimensional perspective view of a portion of a turbomachine diaphragm according to various alternate embodiments of the invention.

FIGS. 6-7 show another alternate embodiment depicting a substantially unitary (without any aperture therethrough) key member 18B which is welded, brazed or otherwise affixed to the packing 4, e.g., within the first key slot 16 in the packing 4. The substantially unitary key member 18B can be placed within the packing 4, and can align axially with a slot 104 in the diaphragm ring 106. In practice, the unitary key member 18B can be placed within the first key slot 16 of the packing, aligned with the slot 104 in the diaphragm ring 106, and welded and/or brazed to the packing 4 within the first key slot 16 to substantially retain the packing 4 circumferentially within the diaphragm ring 106.

It is understood that in any embodiments, the slot and key member configurations could be aligned axially, radially, or at least partially axially and at least partially radially between the packing and diaphragm ring. For example, in various embodiments shown and described with respect to FIGS. 4-7, the key member 18 (e.g., key member 18A, 18B) can extend between the packing and the diaphragm ring in a radial direction or partially the radial direction and partially the axial direction.

It is understood that various aspects of the invention can be applied to any portion of a turbomachine diaphragm. That is, the key/slot configurations described herein can be utilized to stabilize an upper section of a turbomachine diaphragm (above the horizontal joint surface) and/or a lower section of a turbomachine diaphragm (below the horizontal joint surface).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A diaphragm ring for a turbomachine, the diaphragm ring comprising:

a packing slot sized to house a dovetail section of a turbomachine packing, the packing slot extending circumferentially about a rotational axis of the turbomachine, wherein the dovetail section of the turbomachine packing includes a pair of axially extending flanges;

a key slot connected with the packing slot sized to house a portion of a key member, the key slot extending axially from the packing slot, wherein the key slot extends only partially axially into the diaphragm ring from the packing slot, wherein the key slot extends axially into only one of the axially extending flanges from the packing slot; and a retaining slot connected with the key slot and extending substantially circumferentially from the key slot, the retaining slot sized to house a retaining member for retaining the key member, wherein the retaining slot includes a threaded aperture for receiving the retaining member, wherein the retaining member includes a threaded screw.

2. The diaphragm ring of claim 1, wherein the key slot extends circumferentially from a horizontal joint surface of the diaphragm ring to the retaining slot.

3. The diaphragm ring of claim 2, wherein the retaining slot extends substantially circumferentially away from the horizontal joint surface of the diaphragm ring, as well as from the key slot.

4. The diaphragm ring of claim 1, wherein the retaining slot further extends at least partially radially from the key slot.

5. A turbomachine diaphragm comprising:

a packing having a dovetail section including a first key slot, wherein the dovetail section of the turbomachine packing includes a pair of axially extending flanges; and a diaphragm ring coupled with the packing, the diaphragm ring including:

a packing slot sized to house the dovetail section of the packing;

a second key slot connected with the packing slot and sized to house a portion of a key member, the second key slot extending axially from the packing slot, wherein the diaphragm ring includes a horizontal joint surface, and wherein the second key slot extends circumferentially from the horizontal joint surface to the retaining slot, wherein the first key slot extends only partially axially into the diaphragm ring from the packing slot, wherein the first key slot extends axially into only one of the at least one of the axially extending flanges from the packing slot; and a retaining slot connected with the second key slot and extending substantially circumferentially from the second key slot, the retaining slot sized to house a retaining member for retaining the key member, wherein the retaining slot extends substantially circumferentially away from the horizontal joint surface of the diaphragm ring, as well as from the second key slot.

6. The turbomachine diaphragm of claim 5, further comprising the key member positioned within the first key slot of the packing dovetail and the second key slot of the diaphragm ring.

7. The turbomachine diaphragm of claim 5, wherein the key member includes a friction-reducing coating including titanium nitride (TiN).

8. The turbomachine diaphragm of claim 6, further comprising the retaining member coupled to the key member and engaged with the retaining slot.

9. The turbomachine diaphragm of claim 8, wherein the retaining member restricts movement of the key member in the first key slot of the packing dovetail and the second key slot of the diaphragm ring, and wherein the key member restricts movement of the packing relative to the diaphragm ring when the retaining member is engaged with the retaining slot.

10. The turbomachine diaphragm of claim 5, wherein the retaining slot includes a threaded aperture for receiving the retaining member, wherein the retaining member includes a threaded screw.

11. A turbomachine packing comprising:

a main body;

a seal section extending axially inward from the main body and including a plurality of seal teeth; and a dovetail section extending axially outward from the main body, the dovetail section including:

a pair of axially extending flanges; and a key slot within at least one of the pair of axially extending flanges, the key slot sized to receive a key member, wherein the key slot extends entirely radially through the at least one of the pair of axially extending flanges, wherein the key slot extends axially into only one of the pair of axially extending flanges, wherein the main body, the seal section and the dovetail section have a common horizontal joint surface, and wherein the key slot is offset from the horizontal joint surface.

* * * * *